US009114898B2

(12) United States Patent
Wehling

(10) Patent No.: US 9,114,898 B2
(45) Date of Patent: Aug. 25, 2015

(54) APPARATUS AND METHOD FOR FILLING VALVE BAGS WITH DRY BULK MATERIALS

(75) Inventor: Mark Wehling, Ennigerloh-Ostenfelde (DE)

(73) Assignee: HAVER & BOECKER OHG, Oelde (DE)

( * ) Notice: Subject to any disclaimer, the term of this patent is extended or adjusted under 35 U.S.C. 154(b) by 619 days.

(21) Appl. No.: 13/410,842

(22) Filed: Mar. 2, 2012

(65) Prior Publication Data

US 2012/0222391 A1 Sep. 6, 2012

(30) Foreign Application Priority Data

Mar. 2, 2011 (DE) ..... 10 2011 012 879

(51) Int. Cl.

| | |
|---|---|
| ***B65B 1/00*** | (2006.01) |
| ***B65B 3/00*** | (2006.01) |
| ***B65B 9/00*** | (2006.01) |
| ***B65B 43/46*** | (2006.01) |
| ***B65B 1/18*** | (2006.01) |
| ***B65B 43/54*** | (2006.01) |

(52) U.S. Cl.

CPC . *B65B 43/46* (2013.01); *B65B 1/18* (2013.01); *B65B 43/54* (2013.01)

(58) Field of Classification Search

CPC .... B29C 66/8491; B65B 51/225; B65B 1/18; B65B 43/262; B65B 43/30; B65B 7/025; B65B 3/06

USPC ..... 53/139.2, 274, 457, 459, 467–469, 476, 53/266.1, 284.7, 267, 384.1

See application file for complete search history.

(56) References Cited

U.S. PATENT DOCUMENTS

| | | | | |
|---|---|---|---|---|
| 2,732,988 A | | 1/1956 | Feinstein | |
| 4,231,212 A | * | 11/1980 | Raiteri | 53/459 |
| 4,322,932 A | | 4/1982 | McGregor | |
| 4,394,207 A | * | 7/1983 | Berthelsen et al. | 156/578 |
| 4,442,874 A | * | 4/1984 | Ballard, Jr. | 141/166 |
| 4,526,214 A | | 7/1985 | McGregor | |
| 4,561,238 A | * | 12/1985 | Odom | 53/573 |
| 4,688,370 A | * | 8/1987 | Dighton et al. | 53/469 |
| 5,704,197 A | * | 1/1998 | Gifford | 53/571 |
| 6,543,206 B2 | * | 4/2003 | Seward et al. | 53/434 |

(Continued)

FOREIGN PATENT DOCUMENTS

| | | |
|---|---|---|
| CH | 308 711 A | 7/1955 |
| DE | 819 973 C | 11/1951 |
| DE | 1 948 229 A1 | 4/1971 |
| DE | 31 40 332 A1 | 4/1983 |
| DE | 32 20 780 A1 | 12/1983 |
| DE | 36 18 981 A1 | 1/1987 |
| DE | 35 41 697 A1 | 5/1987 |
| DE | 37 00 345 A1 | 7/1988 |
| DE | 37 26 137 A1 | 2/1989 |
| DE | 38 14 337 A1 | 11/1989 |
| DE | 39 29 706 A1 | 3/1991 |
| DE | 40 04 817 A1 | 8/1991 |
| DE | 695 24 875 T2 | 8/2002 |
| EP | 0 095 556 A2 | 12/1983 |
| EP | 0 339 627 A1 | 11/1989 |
| EP | 0 416 534 A1 | 3/1991 |
| GB | 1 273 867 A | 5/1972 |
| GB | 2 183 591 A | 6/1987 |
| WO | 96/01208 A1 | 1/1996 |

*Primary Examiner* — Stephen F Gerrity
*Assistant Examiner* — Eyamindae Jallow
(74) *Attorney, Agent, or Firm* — Pearne & Gordon LLP

(57) ABSTRACT

Apparatus and method for filling valve bags with dry bulk goods including a supporting construction and a filling spout extending laterally from the supporting construction for filling a valve bag provided with a bag body and a valve. A bag holder for guiding the valve bag is provided. For filling, the valve bag is placed onto the filling spout by its valve, hanging from the filling spout during the filling process. The bag holder is displaceable during the filling process from a filling position to a closing position after discharge. An expansion device is provided at the bag holder to expand the valve of the valve bag prior to closing. The bag holder is attached to the supporting construction. During the filling process the expansion device is at least partially inserted into the valve of the valve bag hanging from the filling spout.

14 Claims, 5 Drawing Sheets

(56) References Cited

U.S. PATENT DOCUMENTS

Figure 1:
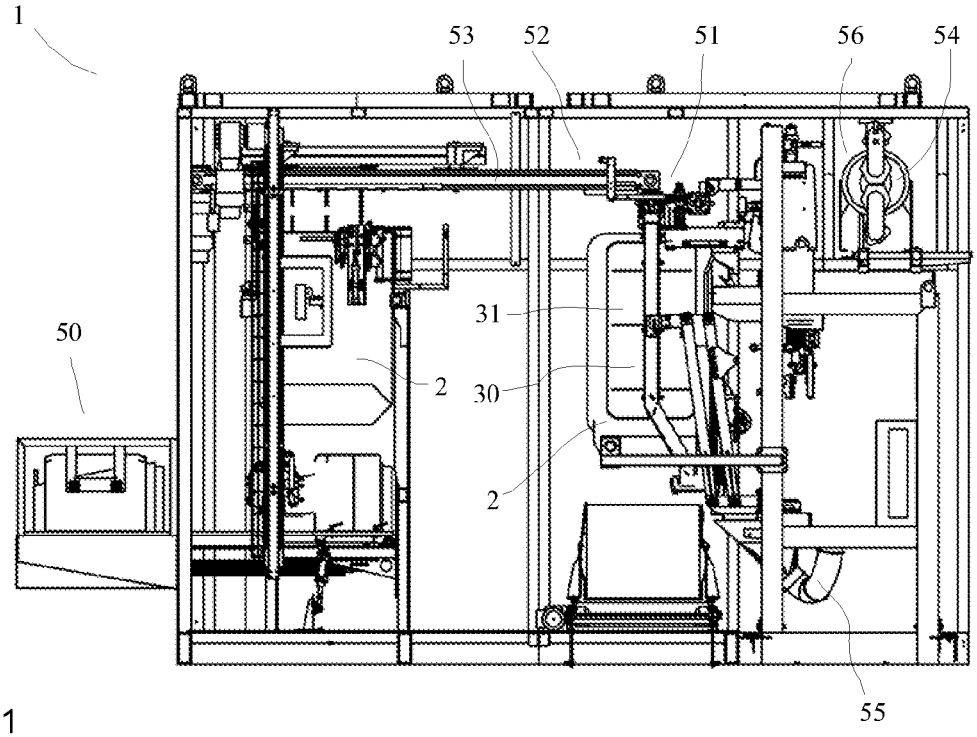

| | | | | |
|---|---|---|---|---|
| 6,748,723 | B2 * | 6/2004 | Wadium et al. | 53/469 |
| 7,681,378 | B2 * | 3/2010 | Brormann et al. | 53/469 |
| 7,698,877 | B2 * | 4/2010 | Combrink | 53/467 |
| 8,245,484 | B2 * | 8/2012 | Yamamoto et al. | 53/75 |
| 2002/0073657 | A1 * | 6/2002 | Wadium et al. | 53/469 |
| 2002/0170276 | A1 * | 11/2002 | Hiramoto et al. | 53/459 |
| 2003/0217530 | A1 * | 11/2003 | Tillack et al. | 53/469 |
| 2005/0257502 | A1 * | 11/2005 | Wild et al. | 53/434 |
| 2007/0089377 | A1 * | 4/2007 | Yasuhira | 53/403 |
| 2008/0236105 | A1 * | 10/2008 | Brormann et al. | 53/469 |
| 2008/0256905 | A1 * | 10/2008 | Graf | 53/459 |
| 2008/0318750 | A1 * | 12/2008 | Combrink | 493/182 |

* cited by examiner

APPARATUS AND METHOD FOR FILLING VALVE BAGS WITH DRY BULK MATERIALS

The present invention relates to an apparatus and a method for filling valve bags with dry bulk materials. Basically, bagging may be provided for any products that can be filled into valve bags such as mineral construction materials, chemical construction products, cement, pigments, and the like.

Valve bags have a bag body and most of them have at one of their lateral top ends a bag valve by way of which the valve bag is placed onto a filling spout of a valve bag filling machine for filling. The bag body is held at the filling spout which tends to be oriented horizontally. After the valve bag has been pushed off the filling spout the valve of the valve bag ensures that virtually no or only very little material can escape from the bag interior since the filling pressure prevailing in the valve bag interior causes the valve to close largely automatically, thus preventing escape of any filled material. Therefore already because of their valves valve bags prevent largely automatically any filled material from escaping.

Therefore, due to increased customer requirements for cleanliness of the bags and/or for example exacting requirements in filling very lightweight materials showing bulk density ranges of less than 0.3 kg/l such as pigments, and given other customer requirements, valve bag filling machines have become known in which the substantially self-closing valves are closed after the filling process by means of a closing seam so as to entirely prohibit any bulk materials from escaping out of the valve of the valve bag. When bagging lightweight materials, large-volume valve bags are employed for filling the intended weight. These valve bags show considerably wider valves over valve bags for receiving cement. Therefore the bag valves become highly instable, tending to take an undefined position after discharge.

It has been shown that e.g. in the case of particularly high loads and stresses even a valve of a valve bag closed by a closing seam can partially or completely open for example if adverse conditions accumulate such as poor bag materials and additional high loads applied on the valve bag.

With DE 40 04 817 A1 to applicant a method and a device for closing valve bags filled by means of a valve bag filling machine have already become known wherein after discharging the valve bag from the filling spout two expansion fingers are inserted into the valve to expand the valve. Thereafter a heated-air nozzle enters into the valve to close the valve. The expansion fingers are removed as soon as possible to prevent the expansion fingers from heating up. Although this prior art works, it does show drawbacks. One drawback is that the hot air blower whirls up filled bulk materials which may lead to considerable contamination. Also, the expansion fingers can be contaminated very easily. Another drawback is that after discharge the expansion fingers must grip the valve which is not always successful in case that the valve buckles or bends away. Coordinated component movements are also difficult.

With DE 819 973, an apparatus for closing the valves at valve bags has become known. Here the valve bags are again discharged from the filling spout of a filling machine after filling. A hot closing assembly is pivoted from a lateral rest position to the operating position. Thereafter the valve collar is expanded and subsequently the valve is clamped by a clamp while a pressure- or temperature sensitive adhesive serves for gluing. The known apparatus permits tight closing of valve bags although it shows the disadvantage of manual operation of the hot closing assembly. With automation, finding the valve cannot be guaranteed since the valves of valve bags do not always show the desired orientation but they may e.g. hang limply off to the side.

With DE 695 24 875 T2 a filling station for filling and closing valve bags has become known. The filling station comprises a filling apparatus and a separate apparatus for discharging the filled bags positioned next to the filling apparatus. The discharging apparatus comprises a base frame standing on the floor. A console is formed by the arms of a parallel-arm controlling arrangement at the discharge apparatus. To discharge a filled valve bag the console of the valve bag is tilted by means of compressed air cylinders to thus have control arms pivoted adjacent to the filling nozzle. Clamping jaw fingers are pivoted between the filling machine housing and the valve of the valve bag hanging from the filling nozzle, entering the valve from the rear. In this position the entire console is moved back such that the valve bag and its valve are pulled off the nozzle while the valve bag is supported by the console from beneath. Thereafter the clamping jaw fingers are pulled away from one another and the valve of the valve bag is expanded such that the initially cylindrical valve opening is flattened and nearly closed. Thereafter the console is tilted and the valve of the valve bag is welded shut.

The drawback of this prior art is the requirement of extensive instrumentation. Moreover it is not always guaranteed that the clamping jaw fingers can be inserted into the valve of the valve bag hanging from the filling nozzle. It may happen that the clamping jaw fingers get stuck at the wall of the valve. Furthermore the filling nozzle must be configured very long for the clamping jaw fingers to be brought completely behind the valve bag hanging from the filling nozzle. Also, the elongated shape may cause statical problems since for example cement bags typically weigh 50 kg. Filled valve bags of less weight at any rate cause considerable bending loads for the filling nozzle. Filling nozzles are basically complicated in manufacture and thus expensive. The elongated shape and the higher loads thus involved make them even more complicated and thus still more expensive.

It is therefore the object of the present invention to provide an apparatus and a method for filling dry bulk goods into valve bags which allows reliable, reproducible, automatic closing of the valve bag while reducing efforts.

This object is solved by an apparatus having the features of claim 1. The method according to the invention is the subject matter of claim 10. Preferred specific embodiments of the invention are the subjects of the respective subclaims.

Further advantages and features of the present invention can be taken from the general description and the description of the exemplary embodiment.

The apparatus according to the invention for filling valve bags with dry bulk goods comprises a supporting construction and at least one filling spout extending laterally from the supporting construction. The filling spout serves for filling a valve bag provided with a bag body and a valve and furthermore comprises a bag holder for guiding and/or supporting and/or discharging the valve bag. For filling, the valve bag is placed onto the filling spout with its valve, hanging from the filling spout during the filling process. The bag holder is displaceable during the filling process at least from a filling position to at least one closing position after discharge. At least one expansion device is provided at the bag holder to expand the valve of the valve bag prior to closing. The bag holder is indirectly or immediately attached to the supporting construction. The expansion device is arranged in the filling position during the filling process such that the expansion device at least partially enters the valve of a valve bag hanging from the filling spout.

The apparatus according to the invention has many advantages. The apparatus according to the invention allows reliable and reproducible closing of the valve of the valve bag by means of a closing seam. By way of disposing the expansion device at least partially inside the valve while the valve bag is hanging off the filling spout by its valve, a defined, reproducible position is ensured at all times. The always identical conditions during closing allows to ensure reproducible edge conditions in closing such that the closing seam will reliably withstand even high and highest loads.

The instrumentation involved is minor. A normal filling spout may be employed. No re-construction with an increased longitudinal extension is required. The wall thickness of the filling spout does not need to be adapted to increased bending loads. Since filling spouts are wearing parts, requiring exchanges on a regular basis, considerable savings ensue.

The invention allows reliable and reproducible, automatic closing in particular of wide and/or limp valves of valve bags as they tend to be employed when bagging lightweight materials.

Another advantage is that use is possible in rotary apparatuses. Each filling spout of a rotary apparatus comprising multiple filling spouts is equipped accordingly so as to allow reliable and reproducible operation. A separate discharge device whose expansion fingers require threading at the discharge position, would necessitate a clocked operation of the system, thus involving drastically decreased output.

A quite considerable advantage is the fact that the valve is precisely held at all times. The flexible or instable valve in the prior art when not guided assumes a random and undefined spatial position. This may result in defective closing processes. This problem arises in particular in the case of large-volume bags for lightweight dry bulk goods having correspondingly large or wide valves. With these materials any escape of materials shows particularly adverse effects. The invention allows to meet high, exacting standards of quality and cleanliness.

The valve of the valve bag is expanded and/or braced in particular following discharge from the filling spout. The expanded valve of the valve bag is in particular fed to a closing device to close the valve by means of a closing seam. The term "expand" in the sense of the present application is in particular understood to mean flat, smooth stacking of the valve walls on top of one another. When expanded the valve walls can, however be—in particular slightly spaced apart from one another ensuing e.g. from the dimensions of the inserted expansion device.

The expansion device is suitable to at least partially enter the valve of the valve bag hanging from the filling spout in the filling position already during the filling process or else prior to the filling process. The expansion device when in the filling position is particularly preferably disposed closer to the filling spout than in the expanded position and/or in the discharge position.

The at least one filling spout is in particular at least substantially aligned horizontally. Or else the filling spout may be oriented inclined to the horizontal. Angles between approximately +/−30° to the horizontal are preferred.

The bag holder serves for supporting the valve bag during the filling process and/or during discharge or for discharge. The bag holder is preferably provided displaceable via a structure of an at least substantially parallelogram type between at least one filling position and at least one closing position and optionally another discharge position. Or else it is possible to discharge the filled valve bag in the closing position such that the closing position and the discharge position may optionally be identical.

The bag holder is attached to the supporting construction. The supporting construction may be configured as a rack or a frame. It is also possible for the supporting construction to be configured as, or to comprise, a housing.

The bag holder may form part of the weighed part of the apparatus. The bag holder may for example be connected with the supporting construction via so-called counterguide links. These counterguide links may be formed as flat strips allowing defined positioning in a plane. In the vertical direction the bag holder is then held via the weighing system.

Preferably the valve of the valve bag is pulled off the filling spout when transferring the bag holder from the filling position to the closing position. To this end there is a nearly linear and horizontal movement of the part of the bag holder retaining the valve bag while the valve is being pulled off the filling spout.

Due to a nearly horizontal movement of the part of the bag holder retaining the valve bag a pressure on the bag interior during discharge is avoided. If the bag body of the valve bag were to be compressed still further during discharge then some of the filled material might still be squeezed out of the valve despite the existing valve. Although valve bags are as a rule provided with a tab-like wall in their valves to automatically close the valve in the case of increased interior pressure, exerting any additional external pressure on the bag body should be avoided while the valve bag is pushed off the filling spout.

The expansion device is disposed at the bag holder such that the expansion device is provided to move together with the bag holder. This allows to expand or to retain expansion of the valve of the valve bag even after transferring the bag holder from the filling position to the closing position and taking it to a defined position.

An expansion device disposed separately from the bag holder would have to be either separately displaceable or else would not pick up the valve of the valve bag until in the closing position.

In all of the configurations it is particularly preferred for the expansion device to comprise at least one and in particular at least two expansion fingers. Particularly preferably a pair of expansion fingers is provided which are advantageously configured comparatively thin at their finger ends.

Particularly preferably the at least one expansion finger enters the valve in the filling position at least in part or it is disposed inside the valve at least in part. Particularly preferably at least one expansion finger enters the valve or is disposed therein at least in part already immediately after placement of the valve bag.

It is particularly preferred for the expansion finger when in the closing position to be disposed within the valve at least in part and to enter the valve at least with the finger.

Pre-positioning the expansion fingers at the filling spout ensures correct insertion of the expansion fingers. Should the valve of a valve bag cant during placing at one of the expansion fingers, a malpositioning of the bag would be detected and this bag would not even be filled. Which in the further course prevents contamination of the system and guarantees safe closing.

It is particularly useful for the expansion fingers to be disposed so as to be located at least partially inside the valve at placing or immediately following placing. To this end it is possible that at least one expansion finger can be inserted at least in part into a depression of the filling spout. Given such a configuration the expansion finger can be inserted into the depression at the filling spout prior to placing the valve bag such that the expansion finger does not or only insignificantly impede the placing of the valve bag onto the filling spout.

Instead of a depression it is also possible for the expansion finger to be covered at the filling spout from the front by means of a cover, nose or the like such that the expansion finger will not impede placing when the valve bag is placed onto the filling spout. To this end the filling spout may be round or oval in cross-section at its front face or near the front face wherein an undercut is provided at least in one position in or at which at least one expansion finger can be disposed.

It is also preferred for the expansion fingers to be slanted at their front faces, thus allowing unimpeded placing of the bag valve without any depressions in the filling spout or without any cover at the filling spout.

In all of the configurations it is preferred to provide at least one holding device by means of which the valve wall can be clamped between the expansion device and the holding device. It is for example possible and preferred to provide a pair of expansion fingers and a pair of holding fingers wherein the valve wall may be clamped between one expansion finger and one holding finger each. The holding device may be provided displaceable as a whole. It is also possible for individual components of the holding device such as the holding fingers to be provided displaceable.

Additionally the expansion fingers also support positioning the bag on the filling spout and fixating the same on the filling spout in combination with the holding fingers. Although a separate bag holder as in the prior art is not required, it may be alternatively employed in conjunction with bag recognition. Recognition may occur e.g. via a light barrier.

In all of the configurations it is preferred for the apparatus to comprise at least one closing device by means of which the closing seam can be placed in the valve. The closing device is disposed such that it places the closing seam between the bag body and the expansion fingers inserted in the bag valve.

The configuration in which the closing seam is provided in the bag valve between the bag body and the expansion fingers inserted in the bag valve, is particularly advantageous. This configuration allows placing the closing seam in the valve while the valve is still being expanded by the expansion fingers. In particular are the expansion fingers in the areas inserted in the bag valve comparatively small in cross-section such that the bag valve which is expanded for example by a pair of expansion fingers is very flat in cross-section. Then the upper and the lower valve walls of the bag valve are almost in contact with one another. Such an expansion ensures a defined orientation of the valve prior to making the closing seam wherein said expansion allows to attain wrinkle-free positioning of the valve walls.

Such a wrinkle-free positioning of the bag valve in a defined position prior to making the closing seam is particularly advantageous since wrinkles considerably diminish the reproducibility and strength of the closing seam. It has been found that in the case of wrinkles in the bag valve the local strength of the closing seam can be considerably diminished such that the intended stressability is not attained. A wrinkle-free closing ensures the intended stressability. Expanding the bag valve prior to making the closing seam reliably avoids these wrinkles so as to ensure a high quality, reproducible closing seam.

In preferred specific embodiments the closing device is provided displaceable between a rest position and an operating position. Then the closing device at the bag filling machine can be provided for example above and/or to the side of the filling spout during the filling process and only for closing will it be displaced from the rest position provided above the filling spout to the closing position.

In all of the configurations it is particularly preferred for the closing device to be configured as a welding device and in particular as an ultrasonic welding device. To this end the closing device comprises in particular a sonotrode and an anvil. It is also possible to provide for example a pair of sonotrodes and one or two anvils.

In all of the configurations it is possible to provide at least one pressure device comprising at least one jaw or pressure jaw by means of which pressure can be applied at least from one side on a valve bag received at the bag holder. This pressure device is for example suitable to apply pressure from both sides on the valve bag hanging off the filling spout at the end of the filling process to extract any air captured in the bag body during the filling process as efficiently and fast as possible. With external pressure applied on the valve bag at the end of the filling process, deaeration will be considerably accelerated. It has been found that the application of pressure prior to bag discharge effects reliable deaeration so as to considerably reduce excess pressure in the bag prior to discharge. In this way any escaping of filled bulk material from the bag interior after discharge can be avoided still further.

The pressure device preferably comprises a pair of jaws or in particular pressure jaws holding the bag during the filling process. When the pressing process for squeezing out excess air is finished, the pressure jaws continue holding the bag. For bag discharge the pressure jaws are displaced together with the bag holder, retaining the discharged bag in a defined position. The jaws guide and hold the discharged bag, thus relieving the expansion fingers or the expansion device. The pressure on the pressure jaws is preferably considerably reduced compared to the pressure applied during filling to avoid any bulk material from escaping from the bag interior.

In the method according to the invention a valve bag is placed onto a filling spout by its valve and an expansion device is at least partially inserted into the valve prior to the filling process. The valve bag is then filled with bulk material at the filling spout. The valve of the valve bag is expanded by means of an expansion device prior to closing.

The method according to the invention also has many advantages since it ensures a reliable, reproducible closing of the valve of the valve bag. Preferably at least one expansion finger of an expansion device is inserted into the valve prior to closing and prior to filling the valve bag.

In particular can the expansion device be inserted into the valve at least partially already at or with placing the valve of the valve bag.

To ensure reliable placing of the valve bag it may be possible to displace the expansion finger or fingers to, and/or place it or them at, the filling spout.

The expansion finger or fingers may be biased in the expansion position after placing or after discharging the valve bag. Preferably the bag holder is transferred from the filling position to the closing position while the expansion fingers remain in the valve. While the bag holder travels from the filling position to the closing position the valve bag is preferably discharged from or pushed off of the filling spout.

It is particularly preferred for the closing device to close the valve while the expansion fingers are still expanding the bag valve. This allows to ensure particularly reliable closing since the valve is precisely retained during the closing process.

On the whole the invention ensures a reproducible closing of the bag valve. When making a welding seam a smooth valve is provided so as to allow a wrinkle-free welding of the valve. Filled materials are thus reliably prevented from re-emerging even when bagging free-flowing and in particular lightweight materials.

It is possible for the expansion fingers to be received at least in part in lateral recesses, grooves, or depressions in the filling spout. Or else it is possible to provide the expansion fingers only with a minor portion or not at all in these recesses, grooves or depressions. Then the expansion fingers are preferably formed such that they do not significantly impede placing the bag onto the filling spout from the front.

In all of the configurations it is preferred for the filling spout to be provided with a swelling collar which is blown up after placing the bag to ensure a tight seat of the bag valve at the filling spout. Prior to valve bag discharge the swelling collar is deaerated so as to allow the valve bag to be pushed off the filling spout.

After the expansion fingers diverge, the bag valve that had originally taken the cross-sectional shape of the filling spout is now spread flat.

Further advantages and features of the present invention can be taken from the exemplary embodiment which will be described below with reference to the accompanying figures.

Figure 2:
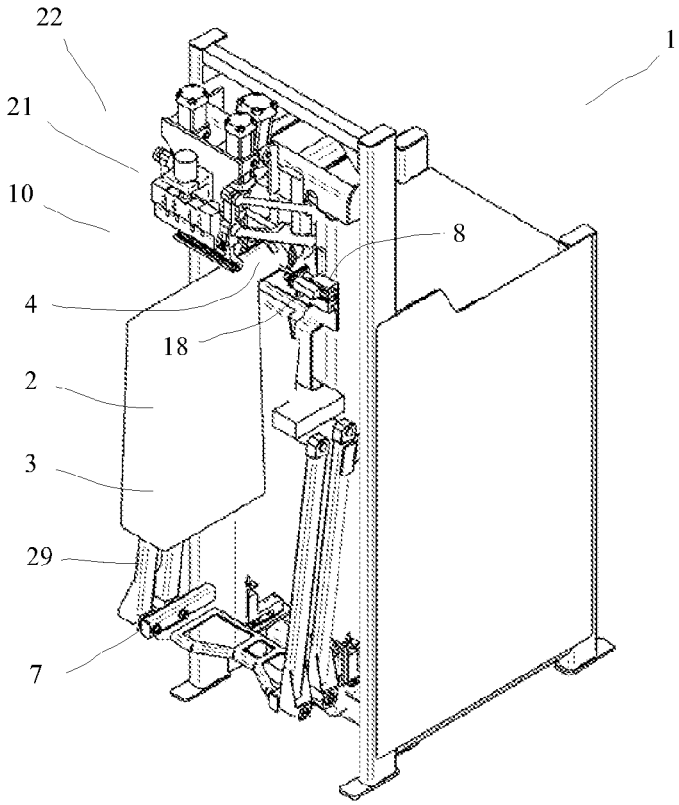
Figure 3:
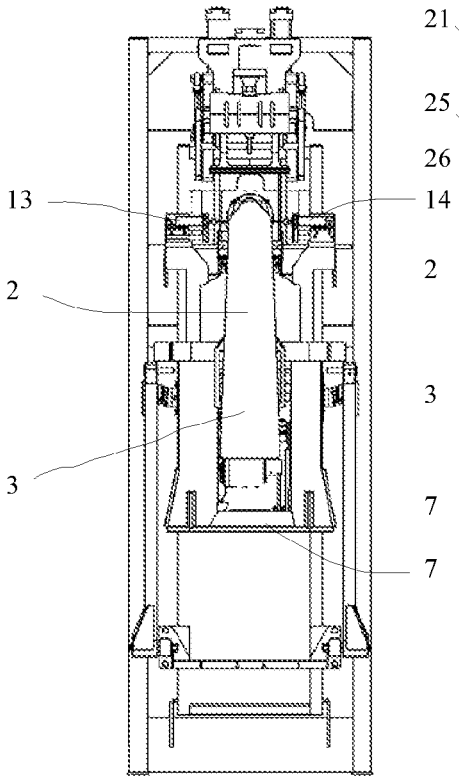
Figure 4:
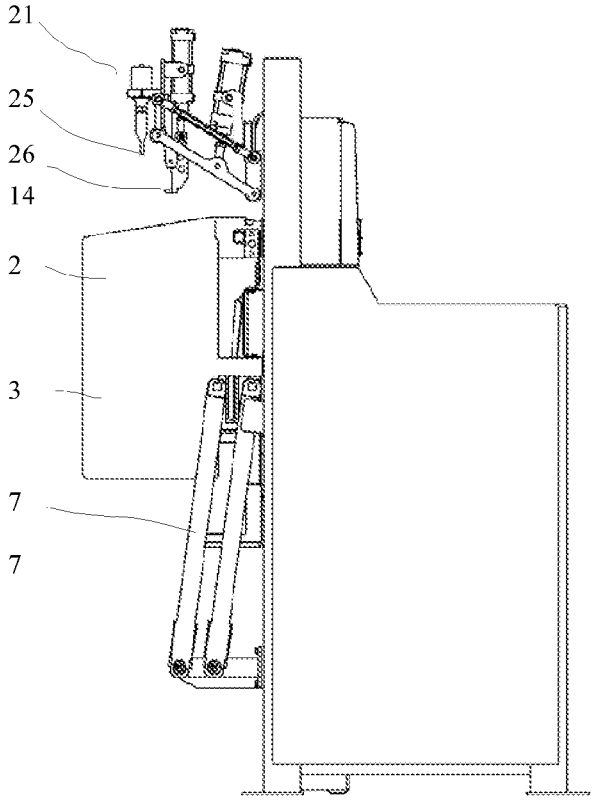
Figure 5:
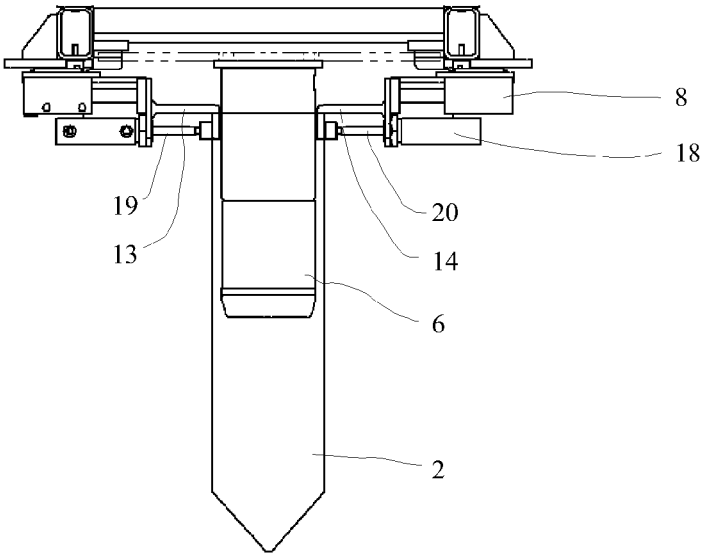
Figure 6:
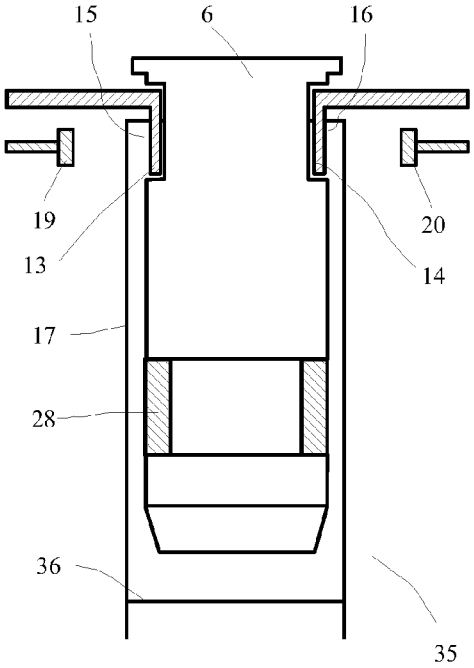
Figure 7:
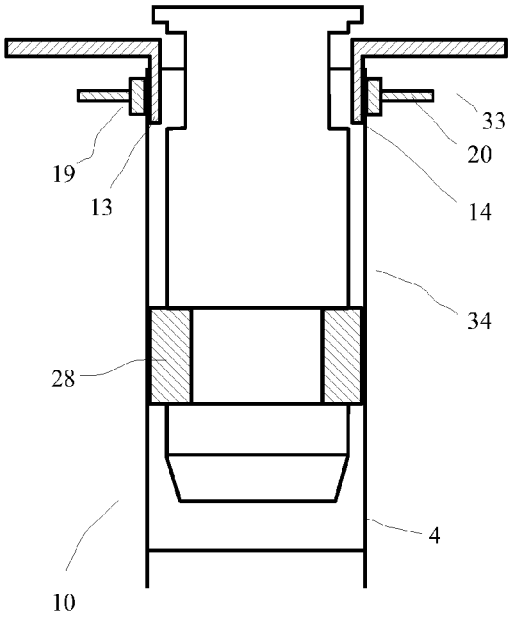
Figure 8:
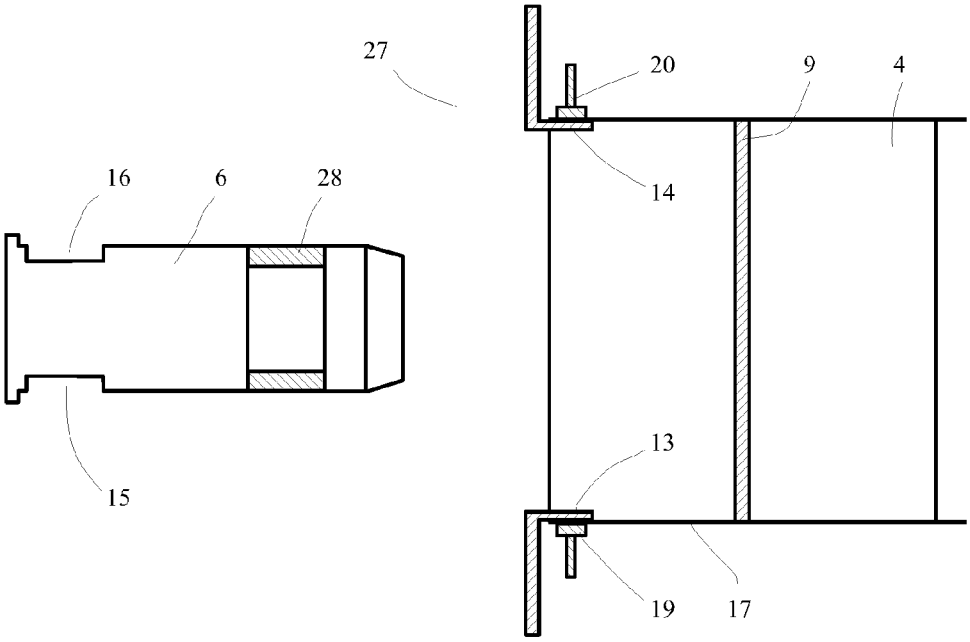
Figure 9:
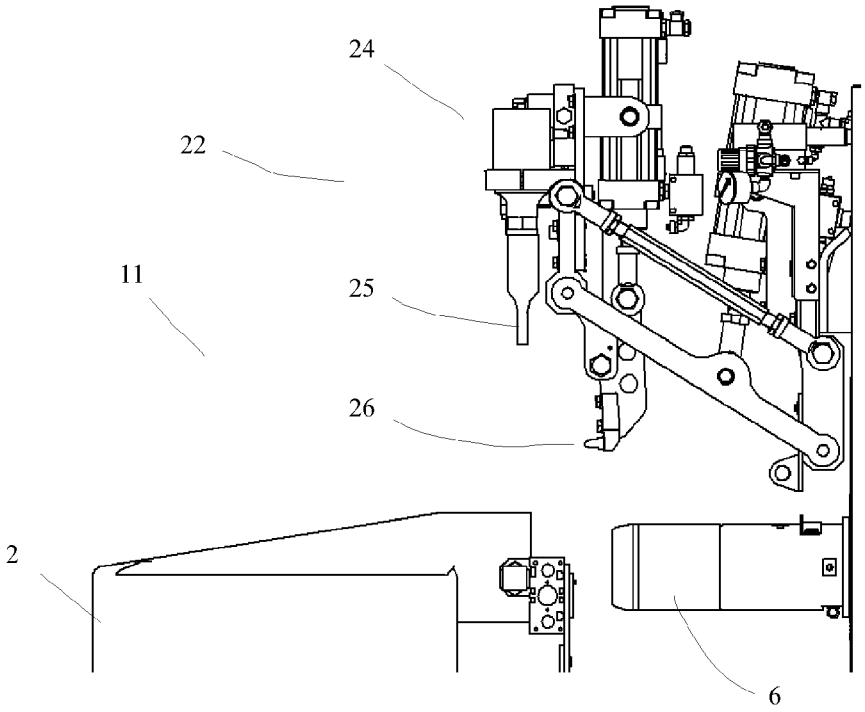
Figure 10:
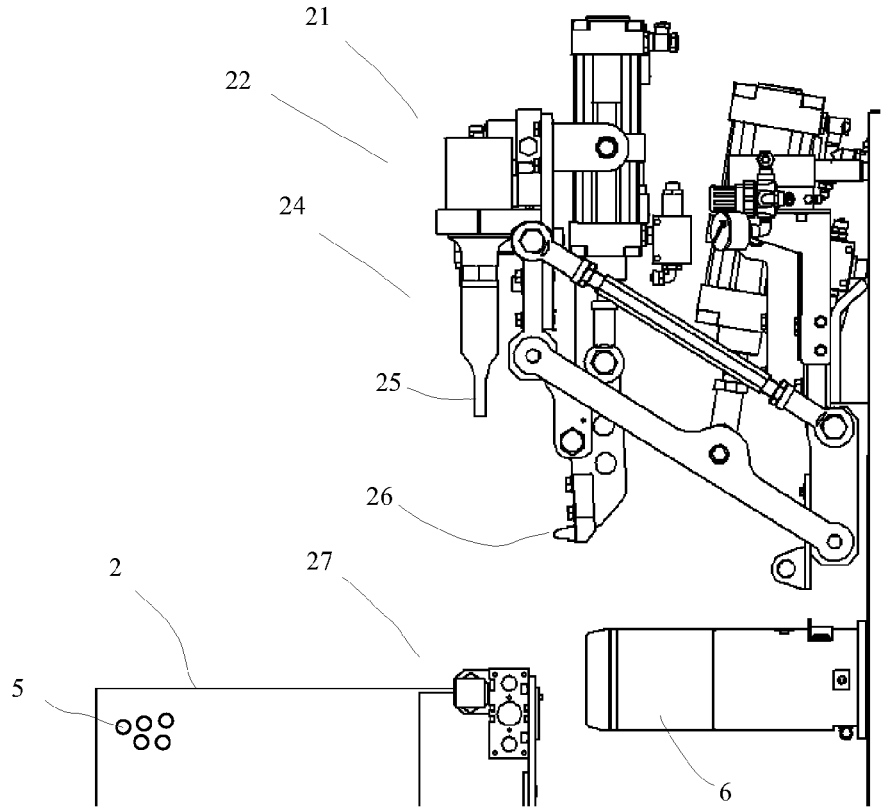
Figure 11:
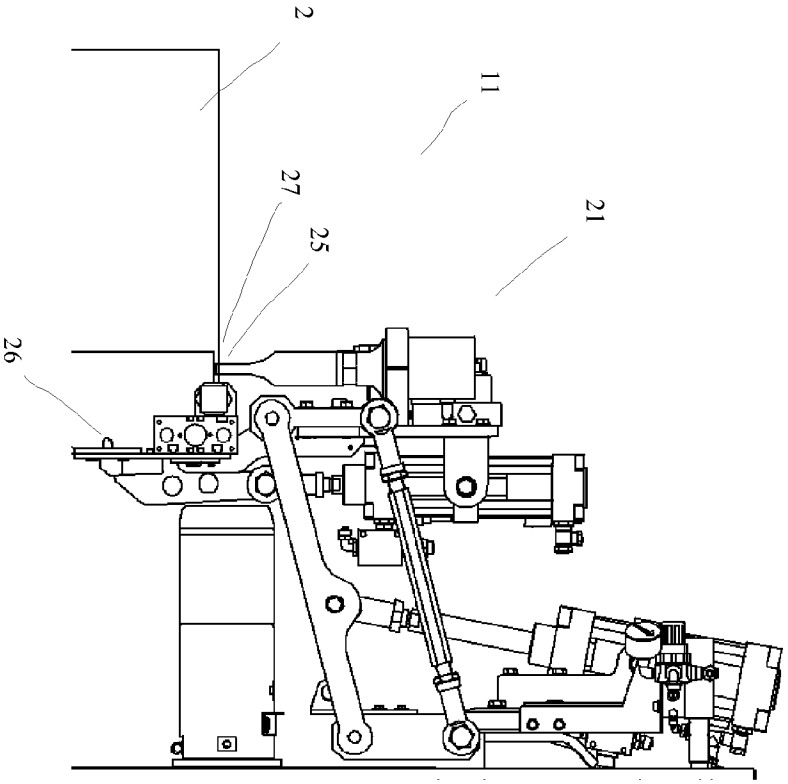
Figure 12:
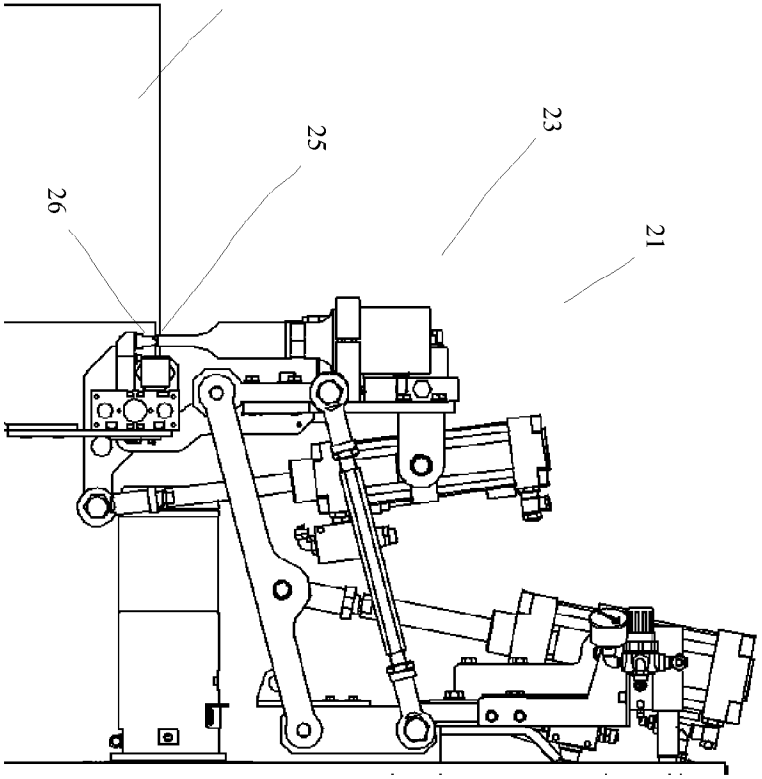

The Figures show in:

FIG. 1 a schematic side view of a packaging machine according to the invention;

FIG. 2 an enlarged perspective schematic view of the part filling the valve bag of the packaging machine according to FIG. 1;

FIG. 3 a front view of the packaging machine according to FIG. 2;

FIG. 4 a side view of the packaging machine according to FIG. 3;

FIG. 5 a schematic top view of the filling spout and a valve bag hanging thereon;

FIG. 6 a schematic cross-section of the filling spout and a hanging valve bag after placing the valve bag;

FIG. 7 a schematic cross-section of the filling spout and the valve bag during the filling process;

FIG. 8 a schematic top view of the filling spout and the bag valve in the closing position;

FIG. 9 a schematic side view of the pushed-off valve bag with the closing device in the rest position;

FIG. 10 a schematic side view of the expanded valve bag with the closing device in the rest position;

FIG. 11 a schematic side view of the expanded valve bag with the closing device in the operating position; and FIG. 12 a schematic side view of the expanded valve bag with the closing device while closing the valve.

FIG. 1 illustrates in a schematic side view an apparatus 1 according to the invention for filling valve bags 2 with the apparatus being configured as a packaging machine 1.

The packaging machine 1 has an empty-bag dispenser 50 assigned to it from which the valve bags 2 are picked up one by one. The valve bag 2 illustrated on the left in the illustration according to FIG. 1 has been picked up separately and subsequently, via the travelling rail 53 of the travelling unit 52, will be placed on a filling spout of the packaging machine 1 by means of the placing device 51, after filling, closing, and discharging the valve bag 2 illustrated on the right in the illustration according to FIG. 1. An aspirator 55 serves for collecting any bulk material that may escape. A conveyor element 54 is employed for conveying the bulk material configured for example as a twin diaphragm pump 56 for bagging particularly lightweight materials. Or else other conveyor elements configured as conveyor turbines or the like may be employed.

FIG. 2 shows in an enlarged perspective illustration the part of the packaging machine 1 carrying out the filling. Optionally the apparatus illustrated in FIG. 2 may be employed as a separate packaging machine 1. To this end the packaging machine 1 illustrated in FIG. 2 would be provided with a bulk material feeder.

Use in rotary packaging machines equipped with a plurality of filling spouts is likewise possible.

As FIG. 2 shows, the packaging machine 1 is provided with a supporting construction 40. The supporting construction 40 may be configured as a rack and/or comprise a frame 41. A casing 42 may be provided so as to form a housing 43.

The packaging machine 1 comprises a bag holder 7 which serves to guide and/or support the valve bag 2 during filling and discharge. The valve 4 of the valve bag is pushed onto the filling spout of the packaging machine 1 while the bag body 3 is hanging downwardly from the filling spout. FIG. 2 illustrates the filling position 10 in which the valve bag 2 is being filled. The closing device 21 is located in the rest position 22 above the filling spout.

The expansion device 8 is presently provided with a pair of expansion fingers 13, 14 not showing reference numerals in FIG. 2 (see FIG. 3), by means of which the bag valve 4 can be expanded after the filling process.

The bag holder 7 can be transferred by means of the parallelogram-type structure 29 from the filling position 10 illustrated in FIG. 2 to a closing position 11.

FIG. 3 shows a front view of the packaging machine 1 from FIG. 2 with the bag holder 7 located in the filling position 10 and with the closing device 21 disposed in the rest position 22.

On the sides one can recognize next to the filling spout the expansion fingers 13 and 14 of the expansion device 8.

FIG. 4 shows the packaging machine 1 according to FIG. 2 in a side view with the bag holder 7 again being in the filling position 10.

One can clearly recognize the sonotrode 25 and the anvil 26 of the closing device 21 configured as an ultrasonic closing device.

FIG. 5 illustrates a schematic top view of the filling spout 6 with a hanging valve bag 2 with the expansion device 8 and the holding device 18 recognizable.

The expansion device 8 presently comprises the expansion fingers 13 and 14 and the holding device 18 comprises the holding fingers 19 and 20.

FIG. 6 shows a schematic top view of the filling spout 6 and a cross-section of the valve bag 2 hanging from the filling spout 6 with the valve bag located in the placing position 35 and the bag holder already in the filling position.

The expansion fingers 13 and 14 or their ends are disposed in the depressions 15 and 16 of the filling spout 6 such that the expansion fingers 13 and 14 do not represent any additional resistance to placing the valve bag 2 onto the filling spout 6.

The holding fingers 19 and 20 of the holding device 18 are located remote from the bag wall 17 to not impede placement of the valve bag 2.

The inserted line 36 indicates the end of the tab-like wall or valve tongue of the bag valve 4.

In the position shown in FIG. 7 the swelling collar 28 is shown in the blown-up state while in the illustration according to FIG. 6 it is in the deaerated state. In FIG. 7 the swelling collar 28 closes the valve 4 tight since the swelling collar 28 sealingly contacts the valve wall 17 of the valve 4. This is the filling position 34 in which the valve bag 2 is filled.

It is possible to bias the expansion fingers 13 and 14 partially or entirely to the expansion position so as to result in the biased position 33 to thus fixate the bag on the filling spout and prevent it from slipping off during the filling process. Then the holding fingers 19 and 20 are placed against the valve wall 17 from the outside so as to retain the valve wall 17 between the holding fingers 19 and 20 and the expansion fingers 13 and 14. Or else it is possible to have the expansion fingers 13 and 14 remain inside the depressions 15 and 16 during the filling process and to provide the holding fingers 19 and 20 spaced apart from the filling spout 6.

FIG. 8 shows the state after completion of the filling process with the bag holder 7 having been transferred by means of the parallelogram-type structure 29 from the filling position 10 illustrated in FIG. 4 to a closing position 11. During transfer of the bag holder 7 from the filling position 10 to the closing position 11 the valve 4 and thus the entire valve bag 2 is pulled off the filling spout 6 so as to result in the position illustrated in FIG. 8 in which the valve 4 of the valve bag 2 is horizontally spaced apart from the front end of the filling spout 6.

Since the expansion device 8 with the expansion fingers 13 and 14 is provided at the bag holder 7, the expansion device 8 travels together with the bag holder 7 to the closing position 11. As the closing position 11 is reached, the expansion device 8 is brought to the expansion position to which end both of the expansion fingers 13 and 14 move away from the filling spout 6. The expansion fingers 13 and 14 the ends of which are still located within the valve 4 of the valve bag 2 expand the bag valve. At the same time the holding fingers 19 and 20 remain abutting the expansion fingers 13 and 14 to thus clampingly receive the valve wall 17 between each other. The valve 4 of the valve bag 2 deforms in expanding during the filling process from the originally round cross-sectional shape to the flat cross-sectional shape illustrated in FIG. 8 in which the top and bottom valve walls virtually lie on top of one another. This allows to insert the closing seam 9 shown in FIG. 8 into the valve 4 of the valve bag 2 virtually wrinkle-free. An undefined position or positioning of the valve 4 during the closing process as might occur in the prior art is reliably prevented by means of the expansion device 8.

FIG. 9 shows an enlarged side view of the valve bag 2 in the closing position 11 in which the valve 4 of the valve bag 2 has been pulled off the filling spout 6. The closing device 21 is located in the rest position 22 presently provided above the filling spout 6. The closing device 21 is presently configured as a welding device 24, comprising the sonotrode 25 and an anvil 26 provided to be pivotable.

FIG. 9 shows the state of the valve 4 immediately following bag discharge from the filling position 10 with the valve 4 in the position illustrated in FIG. 9 still showing the round cross-section of the preceding filling process.

FIG. 9 shows a variant in which expansion only takes place after discharge. Typically, however, the expansion fingers 13, 14 are biased to the expansion position immediately after placing the valve bag 2 such that when pulling the valve bag 2 off, the position illustrated in FIG. 10 will result directly. The direct biasing to the expanding position 27 ensures wrinkle-free placement of the bag valve 4 at the filling spout 6 so as to still more securely ensure a wrinkle-free, defined closure.

FIG. 10 shows the bag valve in the expansion position 27 in which the expansion fingers 13 and 14 have been moved outwardly so as to expand the bag valve 4 and having the top and bottom valve walls 37 and 38 lie flat against one another as is illustrated in FIG. 10. The closing device 21 is still located in the rest position 22.

Subsequently the position illustrated in FIG. 11 is assumed in which the closing position 11 is illustrated. The closing device 21 has been transferred from the rest position 22 to the operating position 23 in which the sonotrode 25 is presently already placed against the valve 4 of the valve bag 2. For closing the anvil 26 must now be pivoted from the position illustrated in FIG. 11 to the position illustrated in FIG. 12.

FIG. 12 shows the state at closing the valve 4 of the valve bag 2 in which the sonotrode 25 and the anvil 26 make a welding seam in the valve 4.

All of the configurations provide for the expansion fingers to be activated separately one by one or else activated together. To this end e.g. compressed air cylinders may be employed. Or else it is possible for the expansion fingers to be activated via a coupling mechanism by way of a joint drive. A compressed air cylinder mechanically coupling the individual expansion fingers may be employed for example. The expansion fingers are particularly preferably arranged at least approximately in a horizontal plane.

On the whole the invention provides a packaging machine and a method for filling dry bulk goods and similar materials into valve bags allowing reproducible closing of the valve bags 2. By way of transferring the valves 4 of the valve bags 2 to the expansion position 27 prior to manufacturing the welding seam, a particularly homogeneous closing seam 9 can be ensured since e.g. wrinkles or the like are reliably prevented during the welding process in the valve 4.

A particular advantage is that the ends of the expansion fingers 13, 14 may remain inserted in the valve during the welding process such that the valve 4 of the valve bag 2 is precisely guided at all times.

List of reference numerals:

| | |
|---|---|
| 1 | packaging machine, apparatus |
| 2 | valve bag |
| 3 | bag body |
| 4 | valve |
| 5 | bulk material |
| 6 | filling spout |
| 7 | bag holder |
| 8 | expansion device |
| 9 | closing seam |
| 10 | filling position |
| 11 | closing position |
| 13 | expansion finger |
| 14 | expansion finger |
| 15 | depression |
| 16 | depression |
| 17 | valve wall |
| 18 | holding device |
| 19 | holding finger |
| 20 | holding finger |
| 21 | closing device |
| 22 | rest position |
| 23 | operating position |
| 24 | welding device |
| 25 | sonotrode |
| 26 | anvil |
| 27 | expansion position |
| 28 | swelling collar |
| 29 | parallelogram structure |
| 30 | pressure device |
| 31 | jaw, pressure jaw |
| 33 | biased position |
| 34 | filling position |
| 35 | placing position |
| 36 | inserted line |
| 50 | empty-bag dispenser |
| 51 | placing apparatus |
| 52 | travelling unit |
| 53 | travelling rail |
| 54 | conveyor element |
| 55 | aspirator |
| 56 | twin diaphragm pump |
| 37 | valve wall |
| 38 | valve wall |
| 40 | supporting construction |
| 41 | frame |
| 42 | casing |
| 43 | housing |

The invention claimed is:

1. Apparatus for filling valve bags with bulk goods comprising a supporting construction and at least one filling spout extending laterally from the supporting construction for filling a valve bag provided with a bag body and a valve comprising at least one bag holder for guiding the valve bag, wherein for filling, the valve bag is placed onto the filling spout by the valve and hanging from the filling spout during the filling process, wherein the bag holder is movable during the filling process at least from a filling position to at least one closing position after discharge, and wherein at least one expansion device is provided at the bag holder to expand the valve of the valve bag prior to closing, characterized in that the bag holder is attached to the supporting construction and that in the filling position the expansion device is disposed such that as the valve bag is placed onto the filling spout and during the filling process the expansion device is at least partially inserted into the valve of the valve bag hanging from the filling spout.

2. The apparatus according to claim 1 wherein the bag holder retains the valve bag during the filling process by means of lateral jaws.

3. The apparatus according to claim 1, wherein the bag holder is provided to move from a filling position to a closing position and/or wherein the valve of the valve bag is pulled off the filling spout during transfer of the bag holder from the filling position to the closing position.

4. The apparatus according to claim 1 wherein the expansion device comprises at least one expansion finger.

5. The apparatus according to claim 4 wherein the expansion finger when in the closing position is at least partially disposed within the valve.

6. The apparatus according to claim 1 wherein at least one expansion finger at least when in the filling position is at least partially disposed in a depression of the filling spout.

7. The apparatus according to claim 1 wherein a holding device is provided by means of which the valve wall can be clamped between the expansion device and the holding device.

8. The apparatus according to claim 1 wherein a closing device is provided to make a closing seam in the valve, the closing device being provided between the bag body and expansion fingers inserted in the bag valve.

9. The apparatus according to claim 1 wherein the expansion device comprises at least two expansion fingers.

10. Method for filling dry bulk goods into a valve bag wherein a valve bag is placed onto a filling spout with its valve and wherein as the valve bag is placed an expansion device is at least partially inserted into the valve prior to the filling process, wherein the valve bag is subsequently filled at the filling spout and the valve of the valve bag is expanded by means of an expansion device prior to closing.

11. The method according to claim 10 wherein prior to filling the expansion device inserts at least one expansion finger into the valve.

12. The method according to claim 10 wherein after placing or discharging the valve bag expansion fingers are biased to the expansion position.

13. The method according to claim 10 wherein the bag holder is transferred from the filling position to the closing position while expansion fingers remain in the valve.

14. The method according to claim 10 wherein the closing device closes the valve while expansion fingers continue to expand the bag valve.

* * * * *